US008061237B2

(12) United States Patent
Hobbs et al.

(10) Patent No.: US 8,061,237 B2
(45) **Date of Patent: *Nov. 22, 2011**

(54) MANUFACTURING RAZOR BLADES

(75) Inventors: Stephen F. Hobbs, West Bridgewater, MA (US); Cheng-Jih Li, Hopkinton, MA (US); Nicolae Neamtu, Scottsdale, AZ (US)

(73) Assignee: The Gillette Company, Boston, MA (US)

( * ) Notice: Subject to any disclaimer, the term of this patent is extended or adjusted under 35 U.S.C. 154(b) by 373 days.

This patent is subject to a terminal disclaimer.

(21) Appl. No.: 11/259,528

(22) Filed: Oct. 26, 2005

(65) Prior Publication Data

US 2007/0163390 A1 Jul. 19, 2007

(51) Int. Cl.
*B21K 21/00* (2006.01)
*B21K 11/00* (2006.01)
*B26B 21/54* (2006.01)

(52) U.S. Cl. ..... 76/101.1; 76/104.1; 30/346.5

(58) Field of Classification Search ..... 76/104.1, 76/101.1; 30/246.3; 83/876, 864, 875, 878–887
See application file for complete search history.

(56) References Cited

U.S. PATENT DOCUMENTS

| | | | | |
|---|---|---|---|---|
| 1,734,554 | A | 11/1929 | Behrman | |
| 2,053,375 | A * | 9/1936 | Nicholas | 225/3 |
| 2,275,517 | A | 3/1942 | Fay | |
| 2,593,307 | A | 4/1952 | Jacobsen | |
| 3,600,804 | A | 8/1971 | Brown | |
| 4,282,996 | A * | 8/1981 | Maeda et al. | 225/2 |
| 4,370,910 | A * | 2/1983 | Suzuki et al. | 83/876 |
| 5,458,025 | A * | 10/1995 | Neamtu | 76/104.1 |
| 5,661,907 | A | 9/1997 | Apprille, Jr. | |
| 5,701,788 | A | 12/1997 | Wilson et al. | |
| 6,581,269 | B2 * | 6/2003 | Someno et al. | 29/558 |
| 6,629,475 | B1 | 10/2003 | Neamtu et al. | |
| 6,957,598 | B2 | 10/2005 | Neamtu et al. | |
| 7,117,925 | B2 * | 10/2006 | Strezov et al. | 164/476 |
| 7,285,174 | B2 * | 10/2007 | Eickemeyer et al. | 148/690 |
| 2004/0221460 | A1 * | 11/2004 | Neamtu et al. | 30/346.5 |
| 2007/0089567 | A1 * | 4/2007 | Li et al. | 76/116 |
| 2007/0089568 | A1 * | 4/2007 | Hobbs et al. | 76/116 |

FOREIGN PATENT DOCUMENTS

| | | |
|---|---|---|
| GB | 548647 | 10/1942 |
| GB | 1 033 003 A | 6/1966 |
| JP | 01 154801 A | 10/2006 |
| WO | WO 98/05478 | 2/1998 |
| WO | WO 02/05984 A2 | 1/2002 |

OTHER PUBLICATIONS

Hobbs et al., U.S. Appl. No. 11/259,553, entitled "Manufacturing Razor Blades", filed Oct. 26, 2005.
Li et al., U.S. Appl. No. 11/259,552, entitled "Manufacturing Razor Blades", filed Oct. 26, 2005.
PCT International Search Report, dated Mar. 19, 2007, 18 pages.

* cited by examiner

*Primary Examiner* — Ghassem Alie
*Assistant Examiner* — Bharat C Patel
(74) *Attorney, Agent, or Firm* — Joanne N. Pappas; Kevin C. Johnson; Steven W. Miller

(57) ABSTRACT

A method of manufacturing razor blades from a strip material includes reducing the thickness of a lengthwise-extending blade edge region of the strip material.

9 Claims, 8 Drawing Sheets

MANUFACTURING RAZOR BLADES

TECHNICAL FIELD

This invention relates to manufacturing razor blades.

BACKGROUND

Razor blades are typically made from a continuous strip of stock material that is hardened and sharpened while the strip travels along a processing line. The strip is then divided in blade length sections used in the manufacture of individual razor cartridges.

In some applications, blades are supported on bent supports that are slidably mounted in the cartridge housing to move up and down during shaving. For example, FIG. 1 shows cartridge 10 with blades 12 slidably mounted in housing 14, and FIG. 2 shows a blade 12 on a support 16. In these applications, the blades cannot overlap and thus have a small dimension "a" from the cutting edge 18 to the back edge 20. The strip material and blade sections, however, must have a sufficient distance from the front edge to the back edge in order to properly secure and hold the material and sections during processing and attaching to blade supports. It thus is necessary to remove a portion of the blade material after processing and attaching so that the blade will have the desired small dimension from the cutting edge to the back edge. In some applications, the rear section 22, shown in FIG. 3, is removed by bending the rear section 22 between 60° and 90° with respect to the front section 24 after the front section has been attached to the blade support. FIG. 3 also shows spot weld 26, used to attach blade 12 to support 16. There typically is an upturned portion at the rear edge 20 of the attached blade section where the rear section has been removed. In some cases the rear section 22 is not easily removed.

In U.S. Pat. No. 6,629,475, a method of manufacturing razor blades is described in which the strip material is offset to provide a portion 22 that is easier to remove.

SUMMARY

The invention generally relates to methods of manufacturing razor blades that include reducing the thickness of a strip material in all or part of the lengthwise-extending region that later becomes the blade edges of the razor blades.

In one aspect of the invention, the method includes (a) pressing a portion of the lengthwise-extending blade edge region to provide the portion with a thickness that is less than the strip material adjoining the region; and (b) converting the strip material into razor blades. The portion may be, for example, at least 15%, at least 30%, at least 50%, at least 70%, at least 90%, or about 100% of the strip material that ultimately becomes the blade edges of the razor blades. "Blade edge", as used herein, includes the wedge-shaped portion of the blade from the sharpened tip to the interception with the flat portion of the blade.

In some embodiments, pressing includes passing the strip material between rollers that contact and reduce the thickness of the strip material.

In some embodiments, pressing provides the lengthwise-extending blade edge region with one or more beveled surfaces. For example, after pressing, the lengthwise-extending blade edge region can have an upper beveled surface and a corresponding lower beveled surface. The beveled surface(s) can be, for example, generally straight, generally concave, or generally convex.

In some embodiments, the lengthwise-extending blade edge portion is generally centrally located on the strip material. In other embodiments, a lengthwise-extending blade edge portion can be located at one or both side edges of the strip material.

In some embodiments, the method further includes offsetting a first lengthwise-extending portion of the strip material from a second lengthwise-extending portion of the strip material and, optionally, subsequently flattening the offset strip material to remove some or all of the offset.

In another aspect of the invention, the method includes contacting a surface of the lengthwise-extending blade edge region with a roller to provide a beveled surface. The beveled surface may extend, for example, at least 15%, at least 30%, at least 50%, at least 70%, at least 90%, or about 100% across the region.

In another aspect of the invention, the method includes converting a strip material including a lengthwise-extending blade edge region that subsequently becomes blade edges on the razor blades and has a thickness that is less than the thickness of the strip material adjoining the lengthwise-extending blade edge region into razor blades including the blade edges.

Reducing the thickness of all or part of the strip material in the region that becomes the blade edges through the above methods can provide, for example, one or more of the following benefits: (1) a reduction in wasted strip material; (2) a reduction in sharpening time and/or an increase in sharpening line speed; (3) an increase in the life of sharpening equipment; (4) a variety of options regarding the shape of the strip material in the blade region of the strip material prior to sharpening; and (5) a variety of options for converting a strip material into multiple strands, which potentially increases the throughput of downstream processes.

In preferred embodiments, the strip material is a metal, for example, stainless steel.

Other aspects of the invention include the strip materials processed using any of the above methods, and razor blades and razor blade precursors made using any of the above methods.

Strip material" means an elongated, flat strip of material, for example, stainless steel or another metal that is at least 500 feet, at least 1,000 feet, or even at least 5,000 feet long.

Length, width, thickness, upper, and lower as applied to the strip material is explained during the discussion of FIGS. 5 and 6.

Other aspects, features, and advantages of the method will be apparent from the Figures, the Detailed Description, and from the claims.

DETAILED DESCRIPTION

Figure 4:
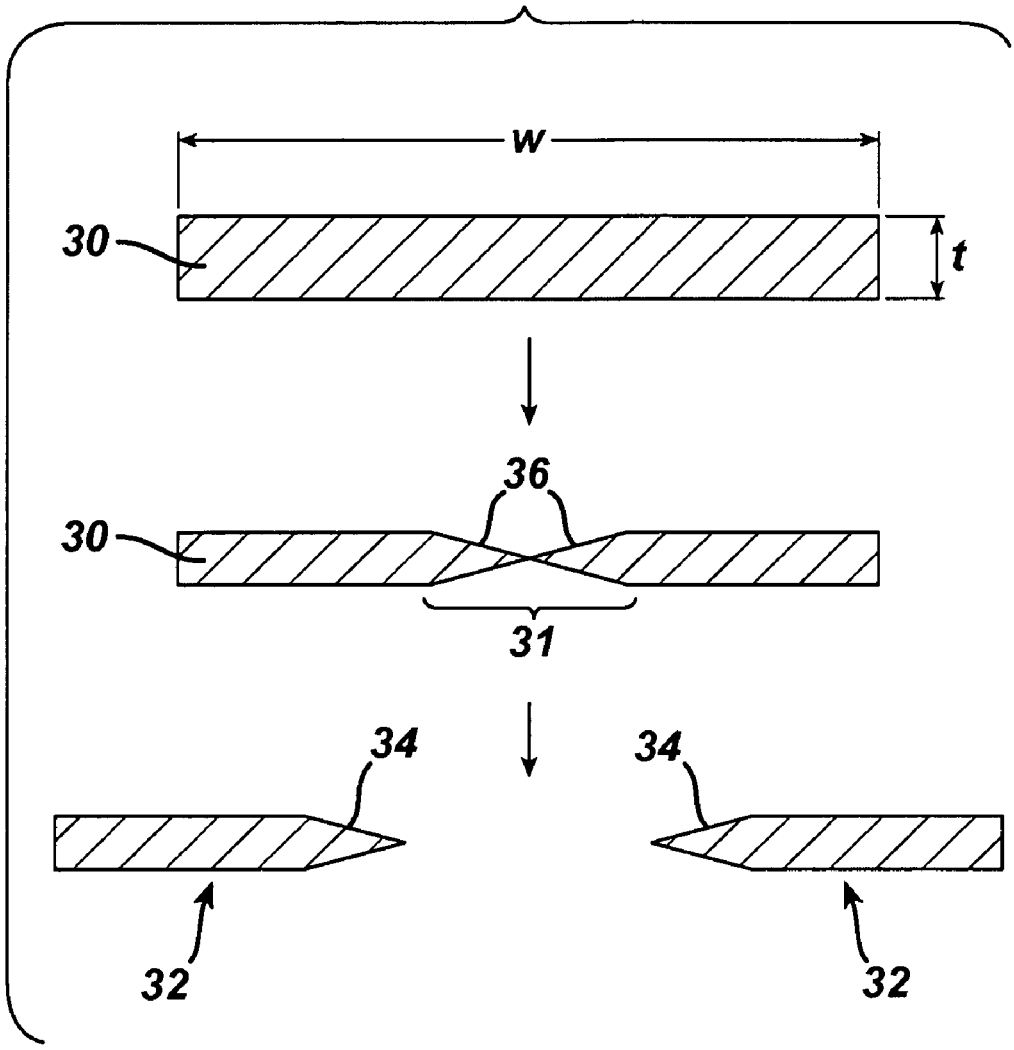
FIG. 4 is a flow chart of a method for making razor blades that also provides section views of the strip material and razor blades.

Referring to FIG. 4, a stainless steel strip material 30 is converted into razor blades 32 having blade edges 34. Strip material 30 has a thickness (t) between about 0.002 inch and about 0.006 inch (for example, about 0.003 inch or about 0.004 inch) and a width (w) sufficient to provide razor blades 32.

Initially, strip material 30 is passed between rollers that press (in this case through rolling down) the strip material along its length at region 31. This reduces the thickness (t) of the strip material in region 31 in a predetermined manner to provide generally straight beveled surfaces 36. Beveled surfaces 36 subsequently are converted to blade edges 34 in razor blades 32.

Figure 1:
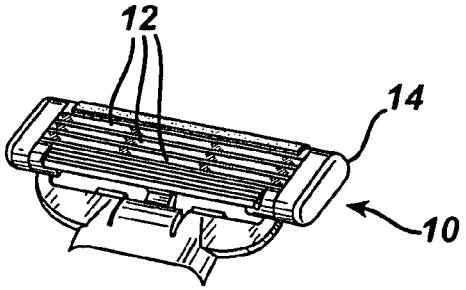
FIG. 1 PRIOR ART
FIG. 1 is a perspective view of a shaving razor cartridge.
Figure 2:
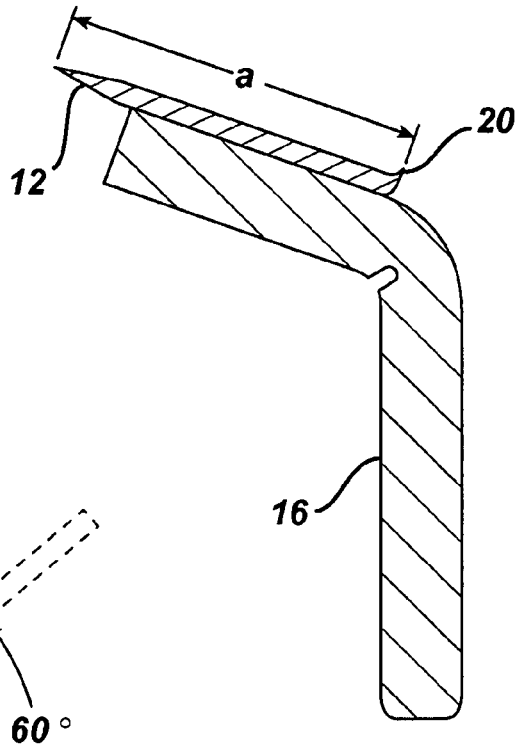
FIG. 2 PRIOR ART
FIG. 2 is a section showing a prior art razor blade used in the FIG. 1 cartridge.
Figure 3:
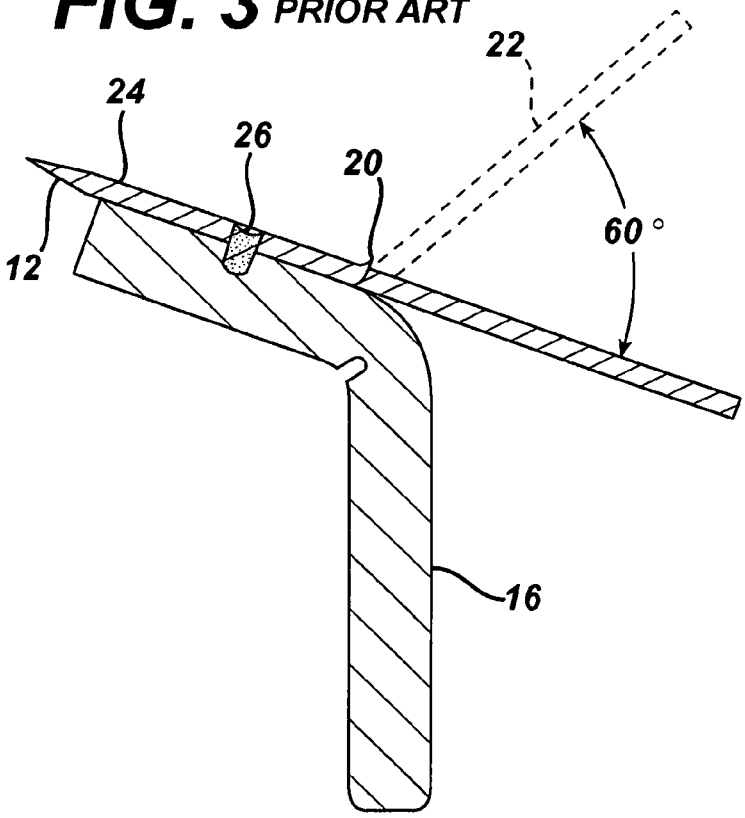
FIG. 3 PRIOR ART
FIG. 3 is a section showing the FIG. 2 blade prior to removal of a rear section used to engage the blade during processing and attaching.

Strip material 30 optionally then is heat treated to harden the stainless steel (step not shown) and the strip material separated at the middle of region 31. Beveled surfaces 36 are sharpened to provide blade edges 34. After sharpening, the separated portions of the strip material 30 are chopped into blade length sections, and each section further processed to provide razor blades 32 (chopping and further processing not shown). Razor blades 32 can be mounted on a razor blade support, such as support 16 in FIG. 2, for example, by welding.

Figure 5:
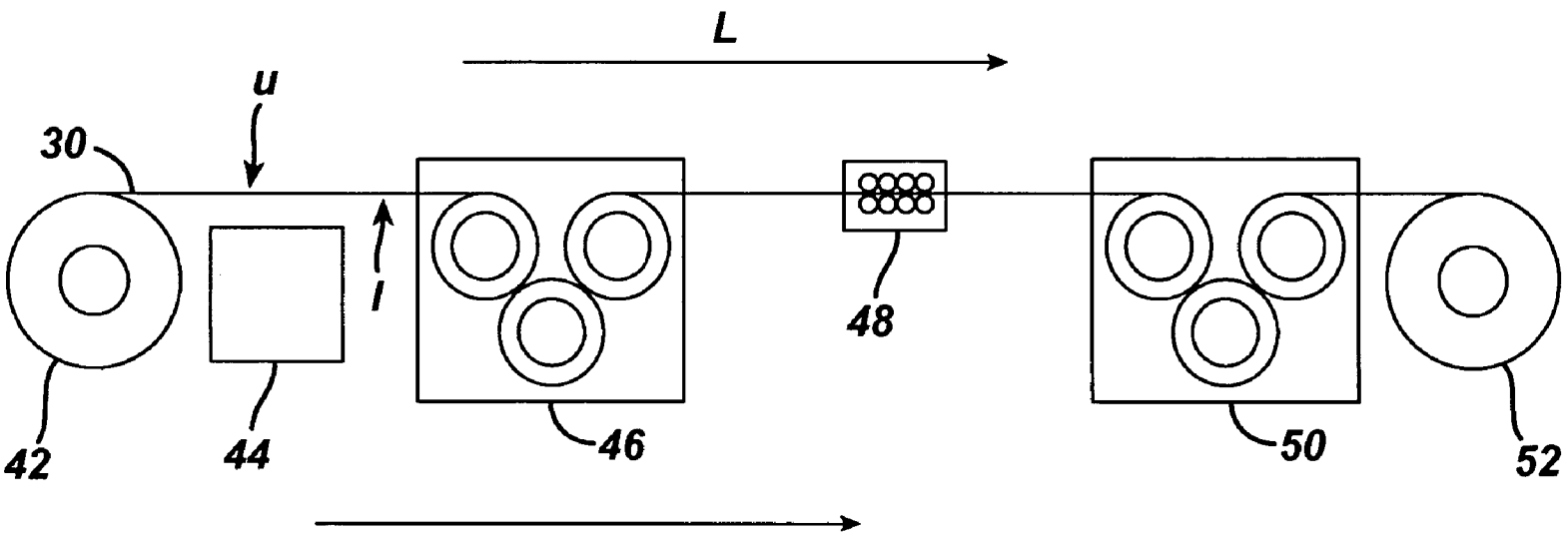
FIG. 5 is a diagrammatic plan view of a process line for performing some of the steps in FIG. 4.

Referring to FIG. 5, a process line for performing the rolling down process in FIG. 4 includes an unwind station 42 for providing a strip material 30. Strip material 30 moves lengthwise in direction L and has upper (u) and lower (l) surfaces. Strip material 30 passes through weld station 44 and tension leveling station 46. Weld station 44 is used when the end of one roll of strip material 30 needs to be attached to the end of a subsequent roll; tension leveling station 46 works with tension leveling station 50 to maintain the appropriate tension on strip material 30 during processing.

Strip material 30 next passes through roll down station 48, which includes the rollers that roll down the strip material in region 36 shown in FIG. 4. Strip material 30 subsequently passes through tension leveling station 50 and is wound onto a spool at winding station 52. The strip material then can be heat treated, separated, sharpened, and made into razor blades. A heat treating station optionally can be provided prior to winding station 52.

Figure 6:
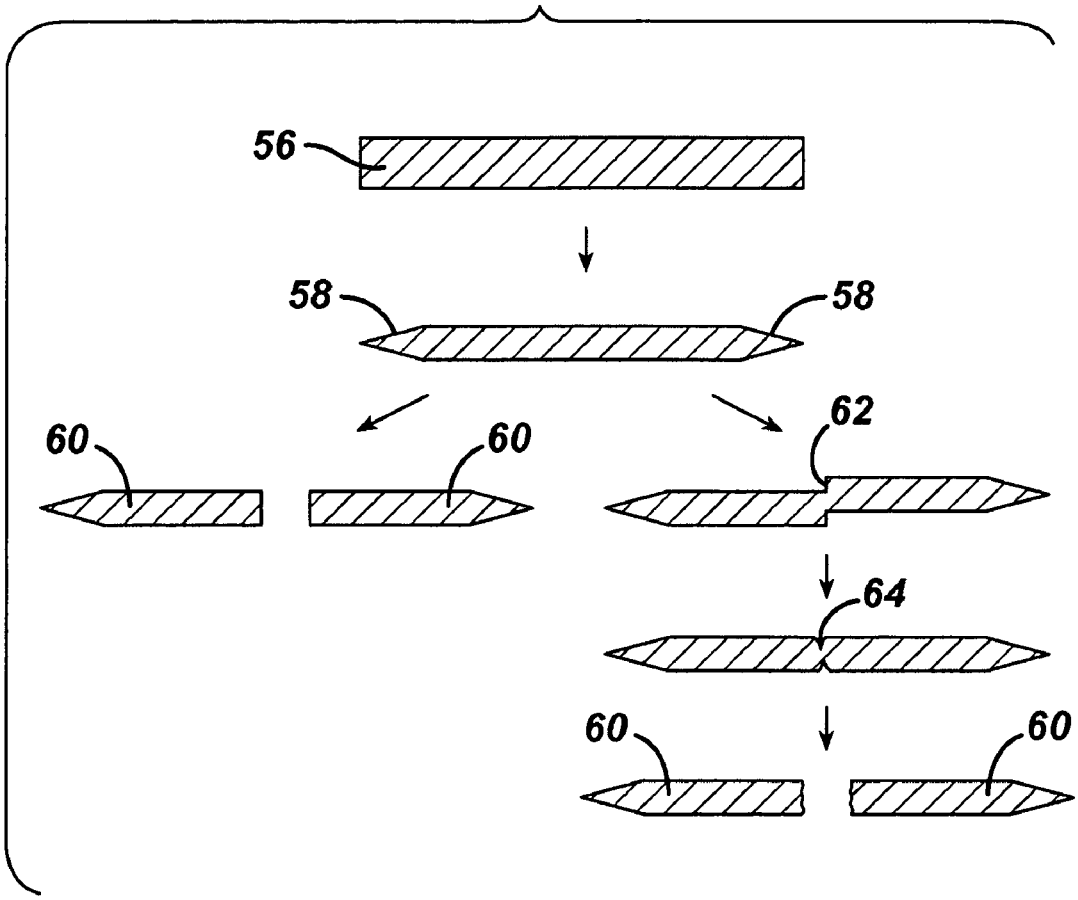
FIG. 6 is a flow chart of a method for making razor blades that also provides section views of the strip material and razor blades.

Referring to FIG. 6, a stainless steel strip material 56 is converted into razor blades 60. Strip material 56 is rolled down at both sides to provides generally straight beveled surfaces 58. Strip material 56 then is slit lengthwise and further processed to provide razor blades 60 (left side of FIG. 6). The further processing includes heat treating and the sharpening of beveled surfaces 58 to provide blade edges; the separated portions of strip material 56 are chopped into blade length sections after sharpening. Optionally, strip material 56 with beveled surfaces 58 can be heat treated, and beveled surfaces 58 sharpened, prior to lengthwise chopping.

Referring to FIG. 6 (right side), alternatively the rolled down strip material is offset along its length at region 62 and then flattened to provide weakened region 64. Offsetting and flattening are described in U.S. Ser. No. _____, which is owned by the same owner as the present application and was filed on the same day as the present application. This application is hereby incorporated by reference. The offset can be, for example, between about 10% and about 50%, and preferably between about 20% and 40%, of the thickness (t) of sheet material 30. Flattening removes, for example, at least 75% of the offset. After flattening, strip material 56 can be separated lengthwise and further processed to provide blade edges; the separated portions of strip material 56 are heat treated and chopped into blade length sections after sharpening. Optionally, strip material 30 can be heat treated, and beveled surfaces 58 sharpened, prior to the lengthwise separation.

Figure 7:
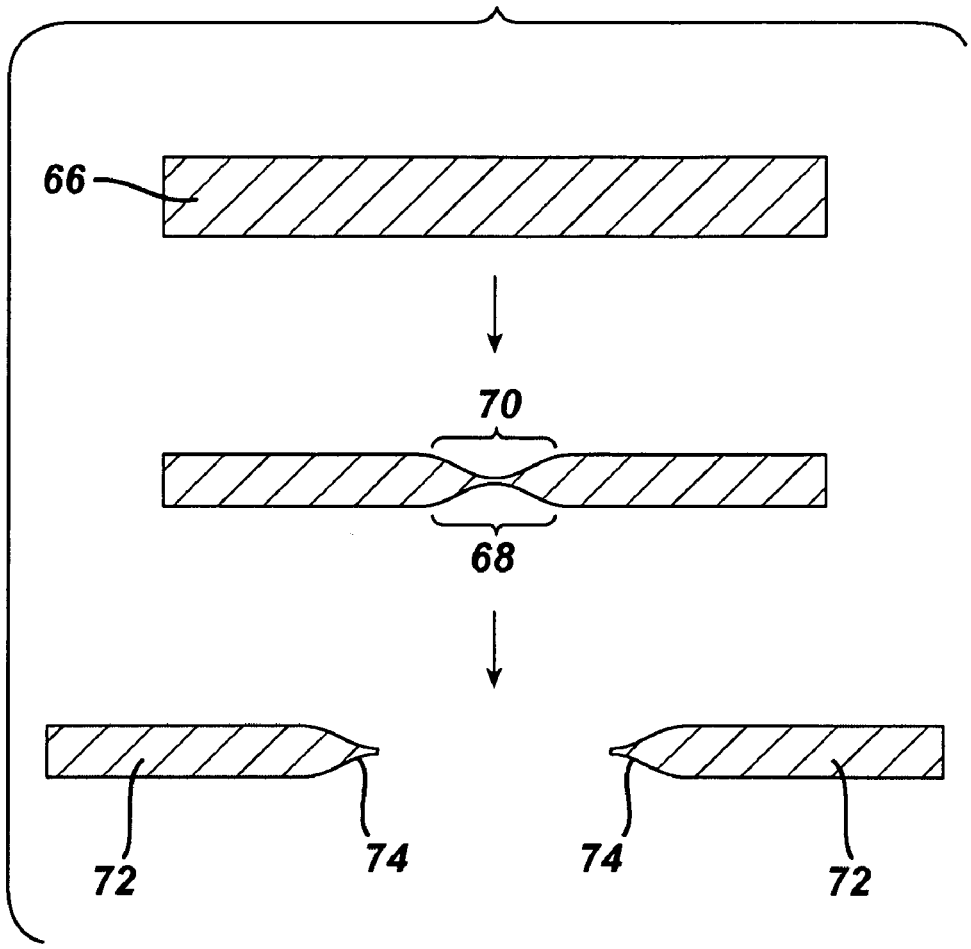
FIG. 7 is a flow chart of a method for making razor blade precursors that also provides section views of the strip material and razor blade precursors.

Referring to FIG. 7, a stainless steel strip material 66 is rolled down along its length at region 68. After roll down, region 68 of strip material 66 includes generally convex beveled surfaces 70. Strip material 66 can be heat treated to harden the stainless steel (step not shown) and the strip material then separated at approximately the middle of region 68 to provide separated portion 72, each including a generally convex beveled surface 74. Surface 74 is sharpened and separated portion 72 is chopped into razor blade length sections, which are further processed to provide razor blades (steps not shown).

Figure 8:
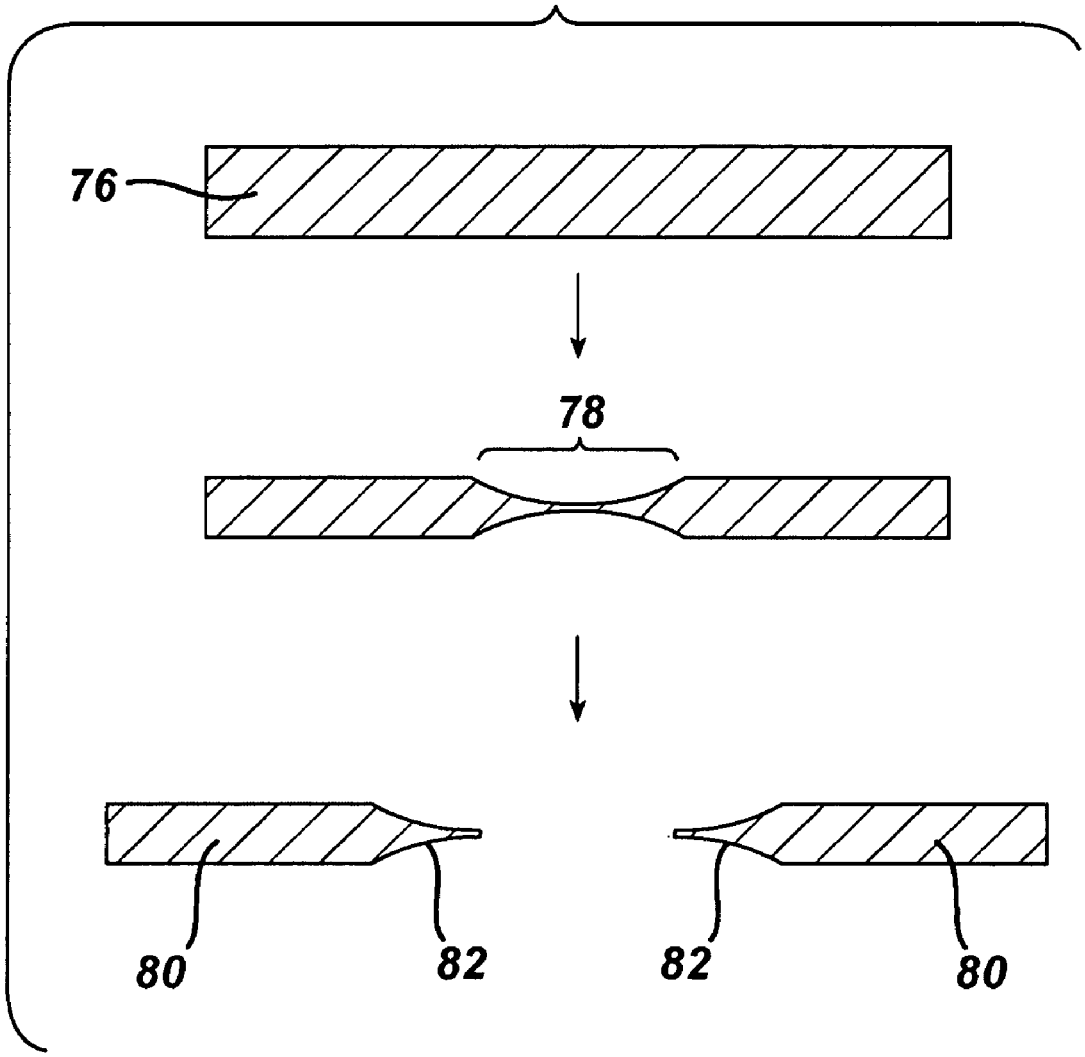
FIG. 8 is a flow chart of a method for making razor blade precursors that also provides section views of the strip material and razor blade precursors.

Referring to FIG. 8, a stainless steel strip material 76 is rolled down along its length to provide generally concave beveled surfaces 78. The rolled down strip material optionally can be heat treated to harden the stainless steel (step not shown) and the strip material separated to provide portions 80, each including a generally concave beveled surface 82. Surface 82 is sharpened and separated portion 80 is chopped into razor blade length sections, which are further processed to provide razor blades (steps not shown).

Figure 9:
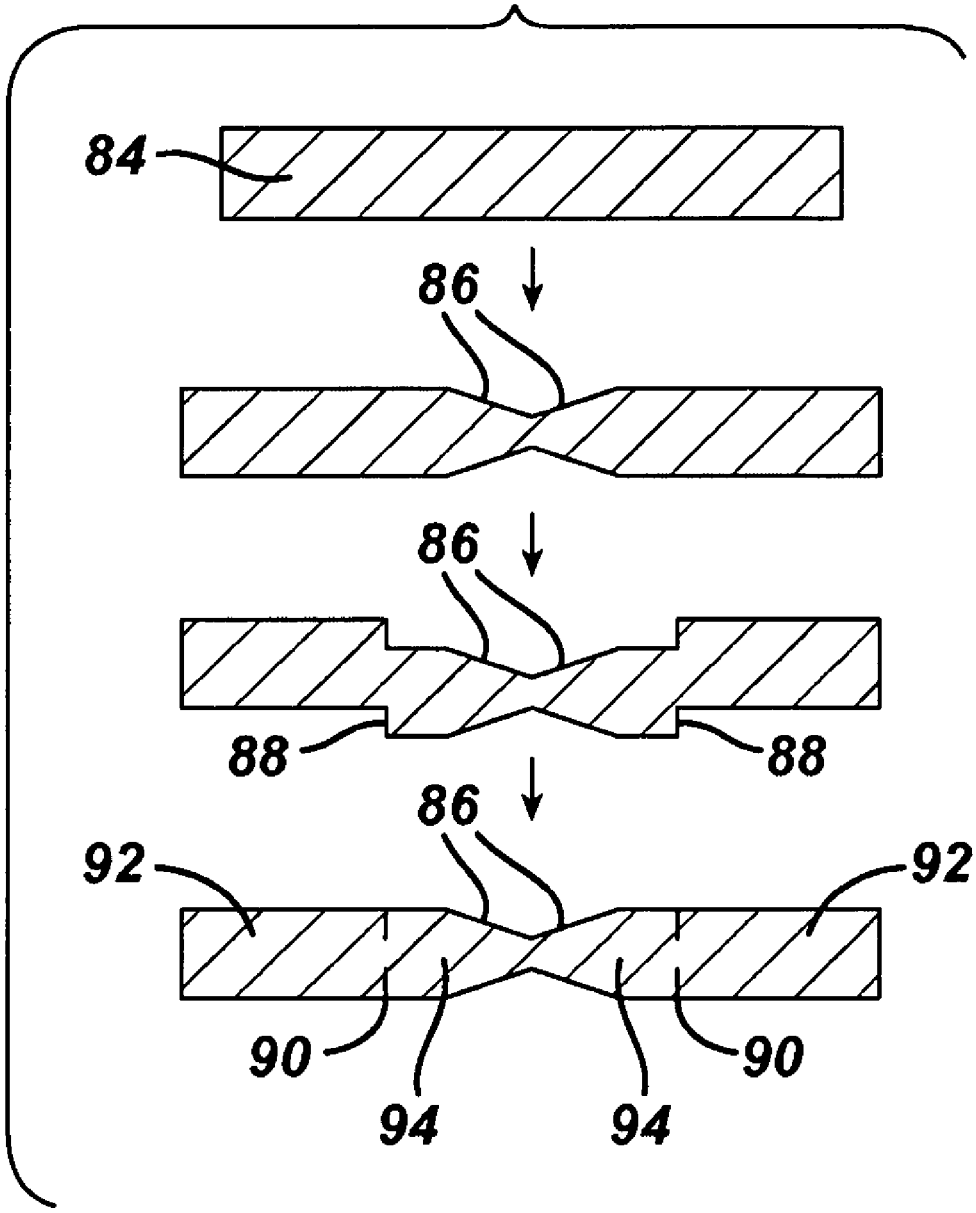
FIG. 9 is a flow chart of a method of processing a strip material that also provides section view of the strip material.

Referring to FIG. 9, a stainless steel strip material 84 is rolled down centrally to provide beveled surfaces 86. The rolled down strip material is then offset along its length at regions 88 and flattened to provide weakened regions 90. Offsetting and flattening are described in U.S. Ser. No. 11/259,553, which was incorporated by reference previously. After flattening, the strip material includes blade portions 94 and blade precursor removable portions 92. The strip material is separated centrally lengthwise either before or after heat treatment and, after further processing including sharpening of separated beveled surfaces 86, converted into razor blade precursors including razor blade portions and removable portions. Razor blade precursors including blade and removable portions is described in U.S. Pat. No. 6,629,475, which also is hereby incorporated herein.

Figure 10:
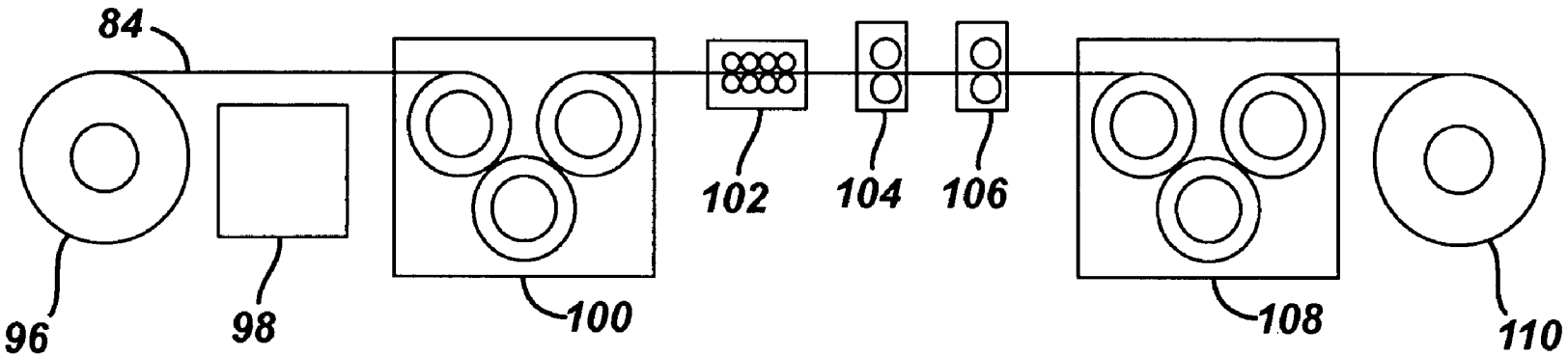
FIG. 10 is a diagrammatic plan view of a process line for performing some of the steps in FIG. 9.

Referring to FIG. 10, a process line for performing the roll down, offset, and flattening steps in FIG. 9 includes an unwind station 96, a weld station 98, tensioning stations 100 and 108, a roll down station 102, and a winding station 110; these stations were discussed previously in connection with FIG. 5. The process line further includes an offset station 104 and a flattening station 106 subsequent to roll down station 102. Offset and flattening stations are described in U.S. Ser. No. 11/259,553.

Other embodiments are within the claims For example, other pressing techniques can be used to reduce the thickness of a portion of the blade edge region of the strip material. Moreover, although strip materials are rolled down on two surfaces in the processes shown in FIGS. 4-10, optionally the strip material can be rolled down on only one surface. Alternatively, when both the upper surface and lower surface are rolled down (or otherwise pressed) one side can be rolled down (or otherwise pressed) more than the other. Thus, in this alternative embodiment one rolled down (or otherwise pressed) surface will vary less in thickness from the adjoining strip material than the other rolled down (or otherwise pressed) surface of the strip material.

In other embodiments, any of the above procedures can be combined with the procedures for thinning, and optionally for controlling the tension, described in U.S. Ser. No. 11/259,552; this application was filed on the same day as the present application, is owned by the same owner, and is hereby incorporated by reference. For example, one optional procedure includes (1) rolling down (or otherwise pressing) the strip material (optionally in combination with offsetting and/or flattening) while also thinning the strip material, (2) adjusting the tension on the strip material to compensate for the added length of the strip material resulting from thinning, and (3) rolling down the strip material a second time (again optionally combined with offsetting and/or flattening). The tension in the strip material optionally also may be adjusted after step (3), if this step also significantly thins the strip material.

Although in the embodiments shown in FIG. 4 and FIGS. 6-9 rolling down decreases the thickness of approximately the entire blade edge region of the strip material, rolling down (or other form of pressing) can be used to reduce the thickness of only a portion of the blade edge region.

What is claimed is:

1. A method of manufacturing razor blades having blade edges from a strip material having a lengthwise-extending blade edge region, the method comprising:

(a) contacting a surface of the lengthwise-extending blade edge region with at least one roller to provide a beveled surface at said blade edge region wherein said strip material is moving in a lengthwise direction on a processing line and maintaining a tension on said strip material by having a first tension leveling station before step (a) working with a second tension leveling station after step (a);

(b) converting the lengthwise-extending blade edge region of the strip material from step (a) into the razor blade edges; and separating the strip material at approximately the middle of the blade edge region, wherein said beveled surface at said lengthwise-extending blade edge region has a thickness that is less than the thickness of the strip material adjoining the lengthwise-extending blade edge region, to form the blade edges of the razor blades.

2. The method of claim 1, wherein the beveled surface extends widthwise at least approximately 30% across the lengthwise-extending region.

3. The method of claim 1, wherein the beveled surface extends widthwise at least approximately 50% across the lengthwise-extending region.

4. The method of claim 1, wherein the beveled surface is generally straight.

5. The method of claim 1, wherein the beveled surface is generally concave.

6. The method of claim 1, wherein the beveled surface is generally convex.

7. The method of claim 1, the lengthwise-extending blade edge region including an upper surface and a lower surface, wherein step (a) comprises contacting the upper surface and the lower surface with rollers to provide a beveled upper surface and a beveled lower surface.

8. The method of claim 1, wherein step (b) further comprises separating the strip material at approximately the middle of the blade edge region wherein said beveled surface at said lengthwise-extending blade edge region has a thickness that is less than the thickness of the strip material adjoining the lengthwise-extending blade edge region, to form the blade edges of the razor blades.

9. The method of claim 8 wherein said upper and lower beveled surfaces each comprise a generally convex beveled surface.

* * * * *